United States Patent [19]

Jones et al.

[11] 4,297,201

[45] Oct. 27, 1981

[54] PROCESS FOR OIL SHALE RETORTING

[76] Inventors: John B. Jones; S. Kumar Kunchal, both of 300 Enterprise Bldg., Grand Junction, Colo. 80501

[21] Appl. No.: 866,358

[22] Filed: Jan. 3, 1978

[51] Int. Cl.[3] ..... C10G 1/00; C10B 21/18; C10B 47/20; C10B 57/12

[52] U.S. Cl. ..... 208/11 R; 201/29; 201/32; 201/36

[58] Field of Search ..... 208/11 R; 201/29, 32, 201/36

[56] References Cited

U.S. PATENT DOCUMENTS

| | | | |
|---|---|---|---|
| 3,573,194 | 3/1971 | Hopper et al. | 201/29 |
| 3,619,405 | 11/1971 | Smith | 201/29 |
| 3,634,225 | 1/1972 | Garbett | 208/11 R |

*Primary Examiner*—Delbert E. Gantz

*Assistant Examiner*—William G. Wright

*Attorney, Agent, or Firm*—Richard D. Law; Bruce G. Klaas

[57] ABSTRACT

Particulate oil shale is subjected to a pyrolysis with a hot, non-oxygenous gas in a pyrolysis vessel, with the products of the pyrolysis of the shale contained kerogen being withdrawn as an entrained mist of shale oil droplets in a gas for a separation of the liquid from the gas. Hot retorted shale withdrawn from the pyrolysis vessel is treated in a separate container with an oxygenous gas so as to provide combustion of residual carbon retained on the shale, producing a high temperature gas for the production of some steam and for heating the non-oxygenous gas used in the oil shale retorting process in the first vessel. The net energy recovery includes essentially complete recovery of the organic hydrocarbon material in the oil shale as a liquid shale oil, a high BTU gas, and high temperature steam.

6 Claims, 1 Drawing Figure

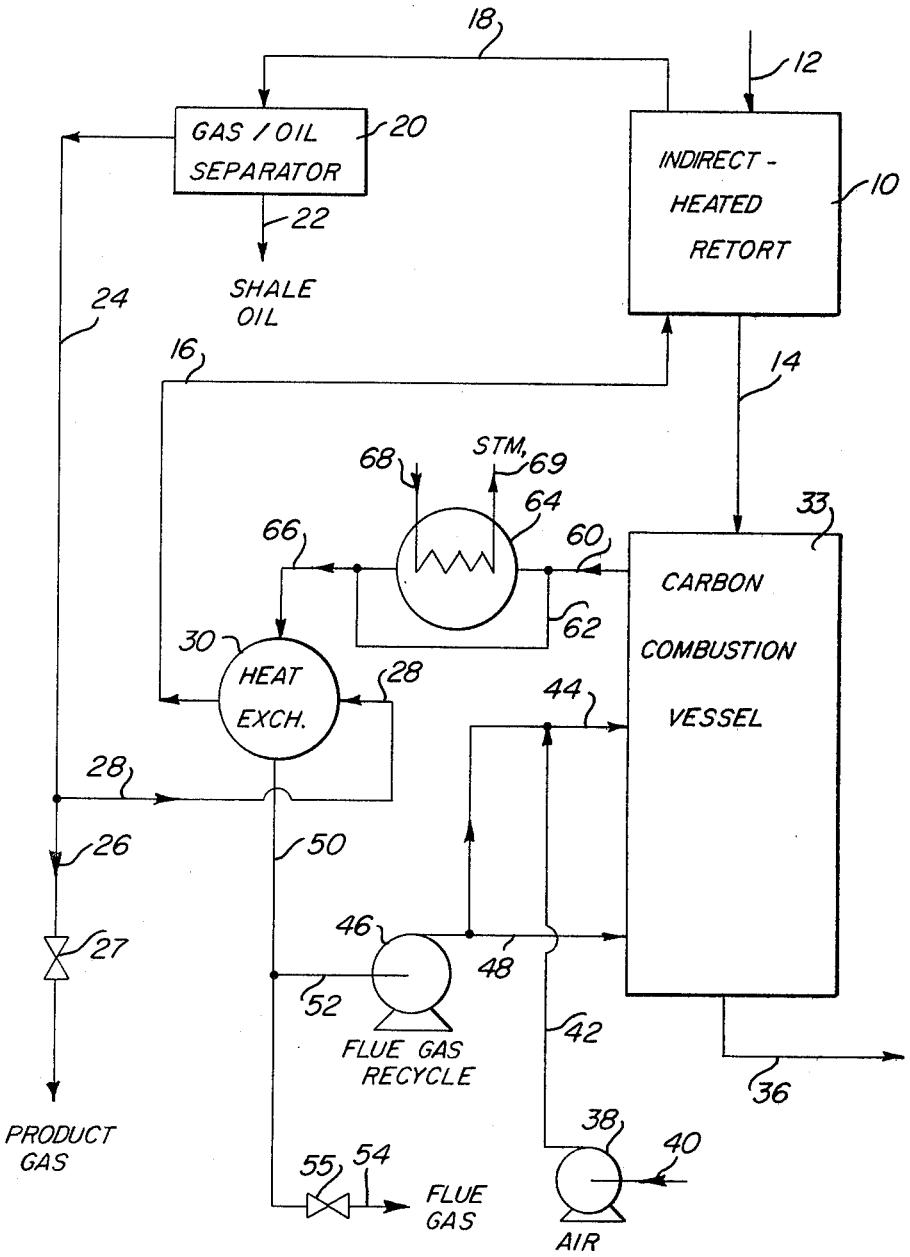
18
12
GAS / OIL SEPARATOR
20
INDIRECT - HEATED RETORT
10
22
SHALE OIL
24
16
14
68
STM.
69
64
33
66
60
CARBON COMBUSTION VESSEL
62
30
HEAT EXCH.
28
44
28
26
50
46
27
48
52
42
FLUE GAS RECYCLE
36
PRODUCT GAS
38
40
55
54
FLUE GAS
AIR

PROCESS FOR OIL SHALE RETORTING

The most common recovery process of an oil from the so-called oil shales of the Western United States, and in other parts of the world, is by a pyrolysis or a retorting process, also called a destructive distillation, of the so-called kerogen material in the particular rock. The pyrolysis of the organic materials of an oil shale is accomplished by heating the shale to a temperature in the order of 900° F. or more. The heat necessary to raise the temperature of the oil shale may be provided in one form as a generally low or non-oxygenous heated gas, or by an actual combustion of some of the combustible material found in the oil shale. The first process is called indirect retorting, and the second is called direct heating retorting. The indirect process uses the generally non-oxygenous gas, or gas with insufficient oxygen for combustion, to prevent combustion the combustible components of the gas or of the oil products of the pyrolysis which are generally released as a vapor or a mist. In the second process, there is a carefully controlled combustion in the bed of shale, accomplished by controlling the quantity of recycle gas and the oxygen content of the gas and the location of the introduction of the gas into the shale bed. The controlled combustion produces a quantity of gas, heated to a high temperature, so that on rising through the bed above the combustion zone, it produces the pyrolysis of the kerogen in the oil shale. The non-combustible matter in the air and the non-combustible products of combustion, including nitrogen, carbon dioxide, etc. provide the heated gas which pass upwardly in the shale bed to the pyrolysis zone.

In the indirect heated process a non-combustible gas, usually a recycled gas from the pyrolysis, or a gas containing little or no oxygen, is externally heated and this is introduced at a predetermined distance below the surface of the shale bed in the retort vessel, providing the quantity of heat for the pyrolysis of the kerogen in the oil shale. From the pyrolysis zone, the products of the pyrolysis and the gas pass upwardly through the incoming shale to heat the same and in turn be cooled for withdrawal of such gases and products of the pyrolysis from the vessel.

The usual methods of such pyrolysis used in both the direct heating mode and the indirect mode include the introduction of a cool gas into the bottom of the shale bed for cooling the retorted shale prior to its release from the bottom of the shale bed. This is to recover heat from the retorted shale by heating the cool gas passing upwardly into the retorting zone. This procedure conserves a substantial amount of the shale residual heat as it passes out of the hot retorting zone.

The process for the indirect heating of oil shale has been the subject of many patents and other literature citations. Various criteria have been proposed for the oil shale retorting in the various processes. In one prior art patent, the indirect heating method of oil shale retorting exemplifies such processes, namely U.S. Pat. No. 3,887,453. This process defines a method for retorting Brazilian oil shales which normally have a high sulfur content, causing considerable changes in the parameters in a process for the indirect heating. Generally, however, this patent sets out a process in a vertical, cylindrical retort where particulate oil shale feed is introduced into the top of the vessel and retorted shale is withdrawn from the bottom at such a rate as to maintain a predetermined bed height of the shale being treated. Hot non-oxygenous gas is introduced into the bed between the top and the bottom surfaces of the shale bed. Cool gas is introduced into the bottom of the vessel and is heated as it rises through the retorted shale. The heated gas introduced into the bottom intermixes with the hot gas introduced into the midportion of the shale bed and the combined gases are proportioned to provide a temperature which produces retorting of the shale. The gas and the products of the pyrolysis rise through the incoming shale to heat the shale and to cool the products of the retorting and the gas. The products of the retorting entrained in the gas are then withdrawn from the vessel above the surface of bed of shale. The process, thus, provides a single vessel retorting system. Specific operating parameters are set forth for the particular oil shale and the particular vessel in other literature citations.

In an attempt to recover sensible heat in the retorted shale, as well as to utilize the residual carbon on the retorted shale, U.S. Pat. No. 3,736,247, describes a two combustion zone direct-heated retorting process in a vertical vessel. The upper combustion zone provides a partial combustion of some of the combustible matter in retorted shale, and a lower combustion zone provides for combustion of some of the residual carbon on the retorted shales. Both combustion zones produce hot products of combustion gases which rise in the shale bed, mix with injected air and then retort the raw shale above the top combustion zone. The process is quite efficient, but requires very precise control of quantity, temperature and composition of all the gases introduced into various parts of the bed. Generally the gases contain some combustible matter as well as oxygen, making a potentially explosive mixture.

Another single vessel indirect heating mode for oil shale pyrolysis is described in U.S. Pat. No. 3,841,992, which, also, injects some steam into the retorted shale to produce additional gases.

THE INVENTION

The present invention provides a system for the pyrolysis of oil shales in which the oil shale is retorted by the indirect method in a separate retort vessel using a non-oxygenous heated gas system. The gases are heated externally of the retort vessel and are then introduced into a bed of oil shale in the pyrolysis vessel to pyrolyze the kerogen in the shale. The gas and the products of the pyrolysis are withdrawn from the retort and are introduced into a separator where gas and liquid are separated according to common procedures. The hot retorted shale is withdrawn from the pyrolysis vessel and is passed into a carbon combustion vessel, where some of the residual carbon on the shale is burned and the hot gaseous products of combustion are recovered. Air and some recycled fluid gas are passed into the carbon combustion vessel for a controlled combustion of residual carbon at a predetermined temperature. The hot gas from this combustion is passed into a steam generator for the recovery of some of the heat in the form of steam. A substantial remainder of the heat in the combustion gases is recovered for the indirect heating of the retorting gases, by passing the gases through a heat transfer unit for heating of the retorting gases, for use in the pyrolysis zone in the first vessel. The products of the process provide low-viscosity shale oil, a high Btu product gas stream [750–900 Btu per SCF], and high temperature steam.

The process of the invention provides a combination of the indirect pyrolysis of oil shale and the combustion of residual carbon on the retorted shale using two separated vessels. The first vessel is for the indirect heating pyrolysis method for oil shale using a non-oxygenous gas, so as to produce no potentially explosive gaseous mixtures, and the second vessel provides the direct combustion of the residual carbon on the retorted shale, providing a waste energy recovery system. This use of the two vessel system alleviates some of the problems found in the single vessel combination mode, for example, the introduction of air or oxygen containing gas into an atmosphere of combustible gases, the separation of gas streams in a single vessel and the like. The pyrolysis of the oil shale in a vessel designed and operated solely for the pyrolysis of oil shale may be effectively controlled to produce maximum pyrolysis and the maximum recovery of the pyrolyzed material from the oil shale. By controlling the overall quantity of gas introduced into the vessel, since no cool gas is used, the separation of the pyrolyzed material and gases is simplified. In the direct combustion of the residual [non-recoverable] carbon matter left on the retorted shale, the combustion may be carefully controlled as it is conducted in a vessel separate from the pyrolysis vessel. This portion of the system provides for the efficient production of sufficient heat to conduct the pyrolysis, and to, also, provide additional heat for process purposes. The direct combustion utilizes some of the carbon residue retained on the retorted oil shale, which cannot be recovered as a liquid or as a gaseous hydrocarbon. Combustion in the combustion vessel is easily controlled providing an effective means for the recovery of energy necessary for the pyrolysis.

It is, therefore, among the objects and advantages of the present invention to provide a novel process for the retorting of oil shale with an efficient and effective total energy recovery from the operation.

Another object of the invention is to provide a method for oil shale retorting including a system for the effective recovery of a substantial portion of the potential energy of the raw oil shale.

Yet another object of the invention is to provide an indirect heated retorting process of oil shale for the recovery of a low viscosity shale oil, a high Btu gas and steam.

An additional object of the invention is to provide a two vessel process for the retorting of oil shale by an indirect heated retorting method and a recovery of heat energy from the retorted shale by combustion of the carbon residue retained on retorted shale, without the inherent dangerous environments of air or an oxygen containing gas mixed with hydrocarbon gas.

These and other objects and advantages of the invention may be readily ascertained by referring to the following description and appended drawing, which is a schematic flow diagram of the process of the invention.

In the drawing, an indirect heated retort 10 is provided for the retorting of oil shale. Preferably the retort is of the vertical kiln type made according to known practices for such vertical vessels. A typical vertical retort is shown in U.S. Pat. No. 4,029,220, among many other patents, being generally a closed vessel having a vertical extent for a gravity, moving bed of oil shale, provided with an upper inlet for particulate shale and a lower outlet for retorted shale, with grate means for supporting the bed in the vessel at a predetermined height. Heated gas for the retorting of the oil shale is introduced into the oil shale bed at predetermined levels below the upper surface, and the products of the retorting are withdrawn from the vessel at a position above the top of the shale bed. Other U.S. Patents showing vertical kiln construction and/or portions thereof include U.S. Pat. Nos. 3,401,922, dated Sept. 17, 1968; 3,432,348, dated Mar. 11, 1969; 3,561,927, dated Feb. 9, 1971; 3,589,611 dated June 29, 1971; 3,777,940, dated Dec. 11, 1973; and, also, 3,841,992, dated Oct. 15, 1974, among others, showing some methods of operating vertical vessels for oil shale retorting.

In the present case, raw shale is introduced through an inlet line 12, and retorted shale is withdrawn from the vessel by a line 14. Heated, generally, non-oxygenous gas introduced into the vessel through a line 16, and the products from the retorting are withdrawn from the vessel through a line 18. The gas flows countercurrent to the descending shale. Since the drawing is schematic, the positions of the inlet and outlet lines represent process flows only. It may be advantageous to inject the hot gas into the middle of the retort. The products of the retorting are passed to a liquid/gas separator arrangement 20, then liquid shale oil is recovered from a line 22, usually directed to run down tanks. Such separation systems are well known and generally include a mechanical liquid-gas separator followed by an electrostatic precipitator. The gas from the liquid-gas separator system 20 is passed through a line 24 where a portion of gas is transmitted through a line 26 as product gas. This line is controlled by a controller 27. The remainder of the gas passes through a line 28 to a heat transfer unit 30, where the gas is heated and then the heated gas passes along line 16 into the retort 10.

The shale as mined as crushed and screened into a size consist suitable for the retorting, for example, in a size consist of approximately $+\frac{1}{4}$ inch to less than about 3 inches (based on the nominal diameter of individual particles). The raw crushed shale is fed into the retort vessel 10, and the hot gas, in a sufficient quantity, is introduced through line 16 to pyrolyze the kerogen of the shale to produce a mist or vapor of the hydrocarbons from the kerogen. The gases introduced into vessel 10 through line 16 at about 1,000° F., and in a sufficient quantity for complete retorting of the shale. The retorting of the shale produces gas, so that a portion of the off-gas can be withdrawn as product gas through line 26. The non-condensed gases are removed through line 24 (from the separator system) at a temperature of about 160° F. The retorted shale passing out of the vessel 10 through line 14 is at a temperature of about 925° F., and generally contains about 2.9% of carbon as residual carbon retained on the shale, and a minor amount of hydrogen, which may be about 0.23%. The hot retorted shale is introduced into vessel 33, which is a vertical kiln, or an equivalent type of unit, through the line 14. The retorted and spent shale is removed from the vessel 33 through line 36 to a retorted and spent shale disposal system. Air or oxygen containing gas is directed into a blower 38 from an intake line 40. The outlet 42 of the blower is introduced into a line 44 which injects the oxygen containing gas into the shale bed in the vessel 33 for the combustion of residual carbon on the shale in the vessel. A blower 46 provides a diluting gas at about 200° F. through a line 48, introduced into the shale bed in the vessel 33 at a level substantially below the line 44. This gas cools the shale from the combustion zone. Recycled gas from the vessel 33 is introduced into a blower 46 from line 50 through an inlet line 52 and then through line 48. The remainder of the gas flowing in the line 50 is discharged as flue gas through line 54. Line 54 is controlled by a control valve 55.

The combustion of the residual carbon in the vessel 33 results in gaseous products of combustion, and these are withdrawn from the vessel by the line 60 at about the top of the vessel at a temperature of about 1,400° F. A balancing or by-pass line 62 by-passes a heat exchanger 64. A line 66 discharging the gas from heat exchanger 64 introduces the hot gas into heat exchanger 30. Water is introduced into the heat exchanger 64 by line 68, and steam is withdrawn from line 69 from the exchanger 64. The gas introduced into heat exchanger 30 from line 66 is maintained at a temperature of about 1,170° F. by means of a balancing line 62.

The following quantitative flow of materials in the process, based on one type of raw oil shale, with a Fischer assay of 28 gallons of oil per ton of shale, illustrates the efficiency of the process. Thus, one ton of particulate oil shale is introduced through line 12 into the retort 10 for the indirect method retorting of the kerogen in the shale. The heated non-combustible gas introduced into the vessel by line 16 is at a temperature of about 1,000° F., and sufficient gas is introduced to provide 400,000 Btu per ton of the oil shale introduced into vessel 10. The retorting of the oil shale in vessel 10 removes about 0.14 tons, so that about 0.86 tons of the retorted shale at about 925° is transferred from vessel 10 into vessel 33. In vessel 33, a portion of the about 2.91% carbon on the shale is burned by the air (or oxygen equivalent gas) supplied by the blower 38 at about 4,500 SCF per ton of shale. This air is diluted by about 5,000 SCF per ton of recycled gas at 200° F. to accurately control the combustion of the carbon on the shale in the vessel 33 and to cool the shale from the combustion for discharge at temperature of about 300° F. The recycled gases into blower 46 are the gaseous products of the combustion withdrawn from vessel 33 by line 60, and after passing through the two heat exchangers it is introduced into the blower 46. Blower 46 provides the 5,000 SCF per ton of recycled gas at 200° F. and, also, provides 10,000 SCF per ton of the recycled gas at 200° F. into line 48 at the bottom of the bed of shale in the carbon combustion vessel 33. This gas passes up through the spent shale to recover its heat and cool the shale down to about 300° F. for withdrawal of the now generally spent shale through discharge line 36. The spent and retorted shale is conveyed to disposal according to conventional practices. The retorted and spent shale amounts to about 0.81 tons containing about 1.5% residual carbon 0.12% hydrogen. The recycled gases from line 48, passing up through the shale bed, recovers the heat in the shale to aid control of the combustion of the carbon, and to thereby add to the recovery of heat in the energy recovery retort 33. The quantity of air introduced into the retorted shale in vessel 33 is sufficient to provide complete use of the oxygen present so that any discharged gases from the retort line 60 do not contain oxygen. The gas withdrawn from vessel 33 by line 60, also, includes recycled gas which has been introduced into the vessel 33 via line 48.

The gas withdrawn by line 60 from the vessel 33 is at a temperature of about 1,410° F., and it is introduced into the heat exchanger or steam generator 64 to provide a hundred pounds of steam per ton of shale at a temperature of about 1,200° F. The gas passing into heat exchanger 30 is at a temperature of about 1,170° F., to heat the recycled gas passing line 28 into line 16 through the heat exchanger 30. This provides the gas at about 1,000° F., and in a sufficient quantity to provide 400,000 Btu per ton of shale to be retorted. The gas from the steam generator 64 passes through the heat exchanger 30 at a rate of about 22,500 SCF/T. A portion of this gas exhausted from the exchanger 30 is introduced into the blower 46, while the remainder is discharged as flue gas at a rate of about 7,500 SCF/T, with an analysis of about 34% $CO_2$; 60% $N_2$ and about 6% water vapor.

The combustion zone temperature in vessel 33 is carefully controlled by dilution with the recycle off-gases from the vessel. This gas provides dilution for the air, and cooling gas for the heated shale. By controlling the temperature of the combustion zone the mineral carbonate decomposition is reduced so as to not exceed about 50%.

The following calculations show the heat balance for the process, the air requirements in the process, and the analysis of the gas produced by the process.

Per Ton of Raw Shale Basis:

1. Heat content in retorted (Indirect Heated I.H.) shale
   $= (925 - 300) \times 0.23 \times 0.86 \times 200$
   $= 247{,}000$ Btu/T
2. Carbon Burning:
   $$14{,}400 \times 0.86 \times \frac{(2.91 - 1.5)\,2000}{100} = 350{,}000 \text{ Btu/T}$$
3. Hydrogen Burning:
   $$62{,}000 \times 0.86\ \frac{(0.23 - 0.12)\,2000}{100} = 117{,}000 \text{ Btu/T}$$
4. Carbonate Decomposition:
   (50% of Min. carbonate, 17.5% in retorted shale)
   $$0.36 \times \frac{17.5 \times 60{,}000 \times 2{,}000 \times 0.5}{100 \times 44} = 205{,}000 \text{ Btu/T}$$

Net Heat recovered by recovery unit
$= 350{,}000 + 117{,}000 + 247{,}000 - 205{,}000$
$= 509{,}000$ Btu/T Heat Requirement for I.H. unit (heating of gas) about 400,000 Btu/T.

Air Requirement:

$C + O_2 = CO_2$
$2H_2 + O_2 = 2H_2O$
$O_2$ requirement = 2.35 Moles for Carbon
0.55 Moles for Hydrogen
2.90

$$\text{Air} = \frac{2.9}{0.21} \times 0.86 \times 379 = 4501 \text{ SCF/T of raw shale}$$

Gas analysis:

| | | | |
|---|---|---|---|
| 34.5% $CO_2$ | = | 2.35 | moles produced from combustion |
| 34.5% $CO_2$ | = | 3.98 | moles produced from Min. Carb. Decomp. |
| 6.0% $H_2O$ | = | 1.1 | moles produced from combustion |
| 59.5% $N_2$ | = | 10.91 | moles produced from air |
| | | 18.34 | |

Heat capacity of gas = 8.9 Btu/Mol/°F.

Off-Gas Temperature:

Total gas leaving carbon combustion vessel = 55 moles
$55 \times 8.9 \times DT = 591{,}000$
$DT = 1207°$ F.
Off-Gas temp. = 1407° F.

In the following table, the property of the gas as produced into the process is generally shown. This is the gas discharged through line 24, and it is generally of the composition shown in Table I, below, which includes about ¼ hydrogen and about ¼ methane on a volume percent basis. The gas, also, includes about 17% $CO_2$.

TABLE I

| | Gas Properties (Dry Basis) Indirect Mode |
|---|---|
| $H_2$ | 24.8 Vol. % |

TABLE I-continued

| Gas Properties (Dry Basis) | Indirect Mode |
|---|---|
| $N_2$ | 0.7 Vol. % |
| $O_2$ | -0- Vol. % |
| CO | 2.6 Vol. % |
| $CH_4$ | 25.7 Vol. % |
| $CO_2$ | 16.6 Vol. % |
| $C_2H_4$ | 9.0 Vol. % |
| $C_2H_6$ | 6.9 Vol. % |
| $C_3$ | 5.5 Vol. % |
| $C_4$ | 2.0 Vol. % |
| $H_2S$ | 5.1 Vol. % |
| $NH_3$ | 1.2 Vol. % |
| H.H.V. | 865 Btu/SCF |

It is to be noted that in the process the recycled gases of the indirect retorted are those produced by the pyrolysis of the indirect method and, therefore, the recycle gas contains very little nitrogen, only small amounts of carbon monoxide, and has a relatively high heating value.

The gases of the carbon combustion vessel, however, are recycled and include a substantial volume of air so that the gas recycled through the process maintains a high percentage of carbon dioxide. This is shown in the following table:

TABLE II

| | |
|---|---|
| $N_2$ | 60% |
| $CO_2$ | 34% |
| $H_2O$ | 6% |

The recovery of the hydrocarbons using the indirect heated mode may be as shown in the following table:

TABLE III

| | |
|---|---|
| Input | |
| Raw Shale - GPT | 28.0 |
| Yield | |
| Shale Oil - GPT | 27.4 |
| Vol. % - Fischer Assay | 98 |
| Gas SCF/T | 850 |

This indirect mode retorting closely conforms to the Fischer Assay, since that method is also an indirect pyrolysis of the oil shale.

What is claimed is:

1. A continuous process for the recovery of energy containing products from oil shale consisting essentially of:
   (a) retorting a particulate oil shale in a separated retort vessel by injecting a heated, generally non-oxygenous recycle gas, from retorting oil shale, into a bed of such oil shale in the retort vessel;
   (b) withdrawing gas and products of retorting from said retort vessel, and withdrawing hot retorted shale containing carbon residue from said separated retort vessel;
   (c) passing said gas and products of retorting to a separation process to remove liquid products from gas, and withdrawing a portion of the gas as a high Btu product gas, and recycling the remainder of the gas to a second heat exchanger;
   (d) passing the hot, retorted shale into a separated combustion vessel;
   (e) injecting oxygen containing gas into said hot retorted shale to burn at least some of the carbon residue to produce hot gases of combustion and retorted and spent shale as waste;
   (f) passing said hot gases of combustion to a first heat exchanger to produce high temperature steam, and
   (g) passing hot gases of combustion from said first heat exchanger to said second heat exchanger to heat recycle gas passing into said retort vessel.

2. A process according to claim 1, wherein said retorted shale is withdrawn from said retort vessel essentially without cooling.

3. A process according to claim 1, wherein cooled gases of combustion from said second heat exchanger are recycled into said combustion vessel to control combustion of the carbon residue on the retorted shale.

4. A process according to claim 1, wherein the heated generally non-oxygenous gas is at a temperature of about 1,000° F.

5. A process according to claim 1, wherein the gases of combustion are withdrawn at about 1,400° F. and the produced steam from the first heat exchanger is at the temperature of about 1,200° F.

6. A process according to claim 1, wherein the quantity of oxygen in the oxygen containing gas injected into the combustion vessel is less than a stiochiometric quantity to burn all the residual carbon so as to produce gases of combustion containing no oxygen.

* * * * *